US009328504B2

(12) United States Patent
Gosling et al.

(10) Patent No.: US 9,328,504 B2
(45) Date of Patent: May 3, 2016

(54) DIVIDER WALL CONNECTION SYSTEMS AND METHODS

(71) Applicant: DIRTT Environmental Solutions, Ltd., Calgary (CA)

(72) Inventors: Geoff Gosling, Calgary (CA); Mogens F. Smed, DeWinton (CA)

(73) Assignee: DIRTT Environmental Solutions, Ltd., Calgary, CA (US)

( * ) Notice: Subject to any disclaimer, the term of this patent is extended or adjusted under 35 U.S.C. 154(b) by 0 days.

(21) Appl. No.: 14/114,019

(22) PCT Filed: Oct. 4, 2013

(86) PCT No.: PCT/US2013/063548
§ 371 (c)(1),
(2) Date: Oct. 25, 2013

(87) PCT Pub. No.: WO2014/055927
PCT Pub. Date: Apr. 10, 2014

(65) Prior Publication Data

US 2015/0218795 A1 Aug. 6, 2015

Related U.S. Application Data

(60) Provisional application No. 61/710,569, filed on Oct. 5, 2012.

(51) Int. Cl.
*E04B 1/98* (2006.01)
*E04B 1/36* (2006.01)
(Continued)

(52) U.S. Cl.
CPC ... *E04B 1/36* (2013.01); *E04B 1/40* (2013.01); *E04B 1/98* (2013.01); *E04B 2/7453* (2013.01);
(Continued)

(58) Field of Classification Search
CPC ..... E04B 2/7437; E04B 2/7424; E04B 2002/742; E04B 1/36; E04B 2/789; E04B 1/98; E04B 1/40; E04B 2/825; E04B 2/7453; E04B 2002/7462; E04C 2/3405; E04C 2002/3488
USPC ..... 52/167.1, 238.1, 127.1, 588.1, 239
See application file for complete search history.

(56) References Cited

U.S. PATENT DOCUMENTS

D26,071 S 9/1896 Howland
1,715,853 A 6/1929 Madsen
(Continued)

FOREIGN PATENT DOCUMENTS

EP 1712694 10/2006
JP 02164984 6/1990
(Continued)

OTHER PUBLICATIONS

International Search Report and Written Opinion for PCT/US2013/063548 mailed Apr. 16, 2015.
(Continued)

*Primary Examiner* — Basil Katcheves
(74) *Attorney, Agent, or Firm* — Workman Nydegger

(57) ABSTRACT

Implementations of the present invention relate to systems, methods, and apparatus for connecting one or more divider walls to structural components of a building. Particularly, at least one implementation includes a flexible connection that can allow at least a portion of the divider wall to move relative to the building's structural components. Consequently, such movement can help the divider wall to withstand seismic events, such as earthquakes.

15 Claims, 8 Drawing Sheets

(51) Int. Cl.

| | |
|---|---|
| ***E04B 2/74*** | (2006.01) |
| ***E04B 2/82*** | (2006.01) |
| ***E04B 1/41*** | (2006.01) |
| ***E04B 2/78*** | (2006.01) |
| ***E04C 2/34*** | (2006.01) |

(52) U.S. Cl.

CPC ..... *E04B 2/789* (2013.01); *E04B 2/825* (2013.01); *E04C 2/3405* (2013.01); *E04B 2002/7462* (2013.01); *E04C 2002/3488* (2013.01)

(56) References Cited

U.S. PATENT DOCUMENTS

| | | | | |
|---|---|---|---|---|
| D172,998 | S | 9/1954 | Sumner | |
| 2,996,157 | A | 8/1961 | Rauth | |
| 3,159,236 | A | 12/1964 | Akerson | |
| 3,174,580 | A | 3/1965 | Schulz | |
| 3,177,970 | A | 4/1965 | Boschi | |
| D204,057 | S | 3/1966 | Logan | |
| 3,526,065 | A | 9/1970 | Lee | |
| 3,770,560 | A | 11/1973 | Elder | |
| 4,076,100 | A | 2/1978 | Davis | |
| 4,269,005 | A | 5/1981 | Timmons | |
| 4,417,426 | A | 11/1983 | Meng | |
| 4,535,577 | A * | 8/1985 | Tenser et al. | 174/495 |
| 4,546,591 | A | 10/1985 | Beltz | |
| 4,708,189 | A | 11/1987 | Ward | |
| D300,803 | S | 4/1989 | Whitley | |
| D306,689 | S | 3/1990 | Hamann | |
| 4,914,873 | A * | 4/1990 | Newhouse | 52/36.1 |
| D313,933 | S | 1/1991 | Petley | |
| 5,050,353 | A | 9/1991 | Rogers | |
| 5,134,826 | A * | 8/1992 | La Roche et al. | 52/584.1 |
| 5,155,955 | A * | 10/1992 | Ball et al. | 52/126.4 |
| 5,172,530 | A | 12/1992 | Fishel | |
| 5,195,286 | A * | 3/1993 | DeLong et al. | 52/220.6 |
| 5,297,368 | A | 3/1994 | Okada | |
| D348,384 | S | 7/1994 | Karsten | |
| 5,349,794 | A | 9/1994 | Taga | |
| 5,487,402 | A | 1/1996 | Clary | |
| 5,732,802 | A | 3/1998 | Tsukagoshi | |
| 5,735,100 | A | 4/1998 | Campbell | |
| 5,852,904 | A * | 12/1998 | Yu et al. | 52/220.7 |
| 5,906,080 | A | 5/1999 | Digirolamo | |
| 5,934,028 | A | 8/1999 | Taylor | |
| D429,998 | S | 8/2000 | Snell | |
| 6,170,202 | B1 | 1/2001 | Davoodi | |
| 6,260,324 | B1 * | 7/2001 | Miedema et al. | 52/481.2 |
| 6,434,895 | B1 | 8/2002 | Hosterman | |
| 6,598,351 | B2 | 7/2003 | Hallberg | |
| 6,679,016 | B2 | 1/2004 | Liu | |
| 6,889,477 | B1 * | 5/2005 | Kottman | 52/238.1 |
| 7,226,033 | B2 | 6/2007 | Foucher | |
| D569,713 | S | 5/2008 | Sandidge | |
| D576,475 | S | 9/2008 | Didehvar | |
| 7,466,286 | B2 | 12/2008 | Chapman | |
| 7,712,260 | B2 | 5/2010 | Vardado | |
| 7,797,901 | B2 | 9/2010 | Near | |
| 7,926,430 | B2 | 4/2011 | Bakker | |
| 7,958,683 | B2 | 6/2011 | Abusada | |
| 8,015,767 | B2 * | 9/2011 | Glick et al. | 52/239 |
| 8,033,059 | B2 | 10/2011 | Contois | |
| 8,046,957 | B2 * | 11/2011 | Towersey et al. | 52/79.9 |
| D696,572 | S | 12/2013 | Petruccelli | |
| 8,601,749 | B2 | 12/2013 | Huene | |
| 8,613,168 | B2 | 12/2013 | Huene | |
| 8,615,936 | B2 | 12/2013 | Huene | |
| D699,547 | S | 2/2014 | Beltz | |
| 8,813,455 | B2 | 8/2014 | Merrifield | |
| 8,899,519 | B2 | 12/2014 | Smith | |
| 2003/0154672 | A1 * | 8/2003 | Spransy et al. | 52/238.1 |
| 2006/0057345 | A1 | 3/2006 | Surace et al. | |
| 2006/0059806 | A1 * | 3/2006 | Gosling et al. | 52/238.1 |
| 2006/0157297 | A1 | 7/2006 | D'Antonio | |
| 2008/0302054 | A1 * | 12/2008 | Gosling et al. | 52/588.1 |
| 2011/0100749 | A1 | 5/2011 | Nonogi | |
| 2011/0146180 | A1 | 6/2011 | Klein | |
| 2011/0147119 | A1 | 6/2011 | Cao | |
| 2014/0157720 | A1 | 6/2014 | Huene | |

FOREIGN PATENT DOCUMENTS

| | | |
|---|---|---|
| JP | 0925621 | 9/1997 |
| JP | 11013176 | 1/1999 |
| JP | 11050574 | 2/1999 |
| KR | 1020020037255 | 5/2002 |
| KR | 101143844 | 5/2012 |

OTHER PUBLICATIONS

International Search Report and Written Opinion for PCT/US2013/063548 mailed Oct. 4, 2013.

International Search Report and Written Opinion for PCT/US2013/063580 mailed Jan. 17, 2014.

International Search Report and Written Opinion for PCT/US2013/063488 mailed Jan. 17, 2014.

Office Action for U.S. Appl. No. 29/473,239 mailed May 5, 2015.

Non-Final Office Action for U.S. Appl. No. 14/722,642 mailed on Nov. 19, 2015.

Non-Final Office Action for U.S. Appl. No. 14/113,252 mailed on Nov. 9, 2015.

* cited by examiner

DIVIDER WALL CONNECTION SYSTEMS AND METHODS

CROSS-REFERENCE TO RELATED APPLICATIONS

The present application is a 35 U.S.C. §371 U.S. National Stage of PCT Application No. PCT/US2013/063548 entitled "Divider Wall Connection Systems and Methods" filed Oct. 4, 2013, which claims the benefit of priority to U.S. Provisional Patent Application No. 61/710,569, filed Oct. 5, 2012, entitled "Divider Wall Connection Systems and Methods." The entire contents of each of the aforementioned patent applications is incorporated herein by reference.

BACKGROUND OF THE INVENTION

1. The Field of the Invention

This invention relates to systems, methods, and apparatus for installing and securing divider walls within a building.

2. Background and Relevant Art

Commonly, builders or architects divide the interior space of residential and commercial buildings into smaller areas. For example, a builder can divide the floor plan in a commercial building into discrete working areas, such as reception areas, offices, conference rooms, etc. To divide the floor space, the builder typically installs divider walls, which define (and separate) the discrete working areas within the building. Such divider walls can be permanent, semi-permanent, or temporary. For instance, the builder or occupants of the building can disassemble and rearrange semi-permanent and/or temporary divider walls to reconfigure the working areas in the building.

In some instances, such divider walls can span an entire height of the floor (i.e., from floor to ceiling). Thus, divider walls can connect to the ceiling at the top end and to the floor at the bottom end. Moreover, typically the divider walls have a rigid connection with structural portions of the building, such as outer walls, floor, and/or ceiling. Commonly, such connections do not allow either end of the divider wall to move relative to the floor and/or ceiling. Furthermore, in installations including a sub-floor and/or suspended ceiling, the wall can easily damage the sub-floor and/or suspended ceiling during a seismic event.

In some instances, however, structural portions of the building can move relative to each other. For example, high-rise buildings can sway, thereby causing relative motion between upper floors of the building. Similarly, buildings located in seismically active areas can (from time to time) experience seismic events, which can cause relative movement between the building's floors. Consequently, such relative movement can stress, damage, and/or break rigidly connected divider walls. Additionally or alternatively, a seismic event can damage the wall's connection with the floor and/or ceiling of the building. In any event, as a result of a seismic event, rigidly connected divider walls can create hazardous conditions within the building.

Additionally, in some instances, the builder can use partial-height divider walls to divide the floor plan into discrete working areas. Particularly, the partial-height divider walls can span less than the entire height of the building's floor. Consequently, the builder can connect only a portion of the partial-height divider wall to a structural component of the building. For example, the builder can connect the bottom end of the divider wall to the floor of the building. Alternatively, the builder can connect the top end of the partial-height divider wall to the ceiling (i.e., a suspended wall).

As noted above, in some instances the structural portions of the building can experience movement. Furthermore, such movement (e.g., movement resulting from seismic events) can translate to structures and objects located on and/or connected to the building's structural components. Typical semi-permanent or temporary divider walls may have insufficient structural support and/or rigidity to adequately withstand the forces transmitted from such movement. Furthermore, movement of the walls can cause damage to connected surfaces, such as floors or ceilings.

Accordingly, there are a number of disadvantages in connecting divider walls to structural components of a building that can be addressed.

BRIEF SUMMARY OF THE INVENTION

Implementations of the present invention solve one or more of the foregoing or other problems in the art with systems, methods, and apparatus for connecting one or more divider walls to structural components of a building. Particularly, at least one implementation includes flexible connections that can allow at least a portion of the divider wall to move relative to the building's structural components. Consequently, in the event that the structural components of the building move relative to each other (e.g., during a seismic event), the flexible connections can minimize, reduce, or eliminate damage to the dividers or the structures to which the dividers are secured.

An implementation includes a wall module for defining one or more individual work spaces within a building. The wall module has an upper section having one or more first vertical supports and one or more first horizontal supports connected to at least one of the one or more first vertical supports. The first vertical supports include first channels therein. Furthermore, the wall module includes a lower section having one or more second vertical supports and one or more second horizontal supports connected to at least one of the one or more second vertical supports. The second vertical supports include second channels therein, and the first and second channels are aligned with each other. In addition, the wall module includes a plurality of mounting supports connected to the lower section. The plurality of mounting supports include third channels aligned with the second channels. The wall module also includes one or more splines coupling the upper section to the lower section. The one or more splines are slidable within the first, second, and third channels, and removing the one or more splines from the first channel and positioning the one or more splines within one or more of the second and third channels decouples the upper section from the lower section.

Another implementation includes a wall module flexibly connectable to one or more structural components of a building. The wall module has a U-shaped channel including a first wall and a second wall having a first distance therebetween. The centering bracket is configured to couple to a structural component of a building. Also, the flexible connection has a frame that includes one or more vertical supports and one or more horizontal supports connected to at least one of the one or more vertical supports. At least one of the one or more horizontal supports has a stringer configured to secure one or more panels. Furthermore, the frame includes a top portion that has opposing rounded faces with a second distance between outermost points threreof. The second distance is equal to or greater than the first distance.

Implementations also include a seismically shiftable wall module for defining one or more individual work spaces within a building. The wall module has a plurality of vertical supports and a plurality of mounting supports securable to a floor of a building. Furthermore, the wall module includes a horizontal support connecting at least two vertical supports of the plurality of vertical supports to the plurality of mounting supports. The wall module also includes a U-shaped channel securable to a ceiling of the building, and a top end connected to or integrated with one or more of the plurality of vertical supports and the horizontal support. In addition, the top end is rotatably securable within the U-shaped channel.

Additional features and advantages of exemplary implementations of the invention will be set forth in the description which follows, and in part will be obvious from the description, or may be learned by the practice of such exemplary implementations. The features and advantages of such implementations may be realized and obtained by means of the instruments and combinations particularly pointed out in the appended claims. These and other features will become more fully apparent from the following description and appended claims, or may be learned by the practice of such exemplary implementations as set forth hereinafter.

BRIEF DESCRIPTION OF THE DRAWINGS

In order to describe the manner in which the above-recited and other advantages and features of the invention can be obtained, a more particular description of the invention briefly described above will be rendered by reference to specific embodiments thereof which are illustrated in the appended drawings. For better understanding, the like elements have been designated by like reference numbers throughout the various accompanying figures. Understanding that these drawings depict only typical embodiments of the invention and are not therefore to be considered to be limiting of its scope, the invention will be described and explained with additional specificity and detail through the use of the accompanying drawings in which.

DETAILED DESCRIPTION OF THE PREFERRED EMBODIMENTS

Implementations of the present invention provide systems, methods, and apparatus for connecting one or more divider walls or wall modules to structural components of a building. Particularly, at least one implementation includes flexible connections that can allow at least a portion of the wall module to move relative to the building's structural components. Consequently, in the event that the structural components of the building move relative to each other (e.g., during a seismic event), the flexible connections can minimize, reduce, or eliminate damage to the wall modules or the structures to which the divider walls are secured.

For example, flexible connections can secure the wall module to the building's ceiling and/or floor. Accordingly, during a seismic event (e.g., when the building's ceiling and floor move relative to each other), the flexible connections that secure the wall module can minimize, reduce, or eliminate damage to the divider wall as well as to the structures adjacent thereto. Furthermore, the builder can rigidly secure the wall module to a first structural component and flexibly to a second structural component of the building. Thus, the wall module can move together with the first structural component and relative to the second structural component, without damaging either the rigid connection or the flexible connection. Moreover, facilitating such movement can allow the wall module to remain undamaged during and after the movement.

The flexible connection can allow the wall module to move in a two dimensional space relative to the structural component. Additionally or alternatively, the flexible connection also can allow the wall module to move in a three-dimensional space relative the structural component. In other words, the wall module can have sufficient degrees of freedom to move relative to the structural component, as may be necessary to avoid damage to the connections and/or to the wall module. In one or more implementations, one or more flexible connections also can be sufficiently rigid to maintain and/or secure the wall module in a stationary position when the structural components of the building remain unaffected by a seismic event.

At least one implementation includes a modifiable wall module, which the builder or occupants of the building can reconfigure from a full-height configuration to a partial-height configuration, and vice versa. Particularly, the partial-height reconfigured wall module (i.e., reconfigured from full-height to partial-height configuration) can have sufficient structural rigidity to withstand movement of the structural components to which they are secured. Furthermore, the builder or occupants of the building can reuse portions of the full-height modifiable wall module to provide sufficient reinforcement and/or structural rigidity to the partial-height divider wall.

Figure 1A:
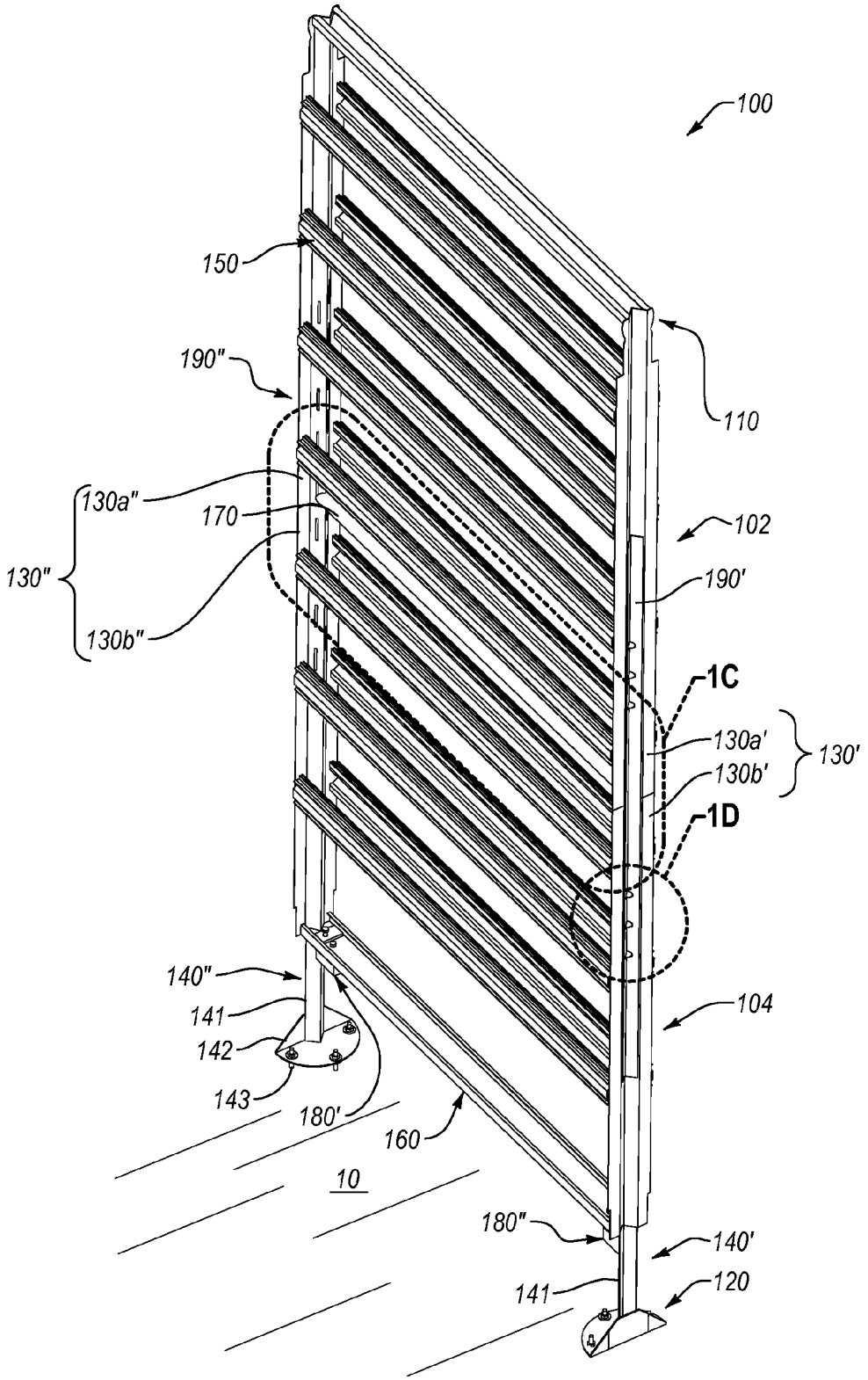
FIG. 1A illustrates a perspective view of a frame for a wall module in accordance with one implementation of the present invention.
Figure 1B:
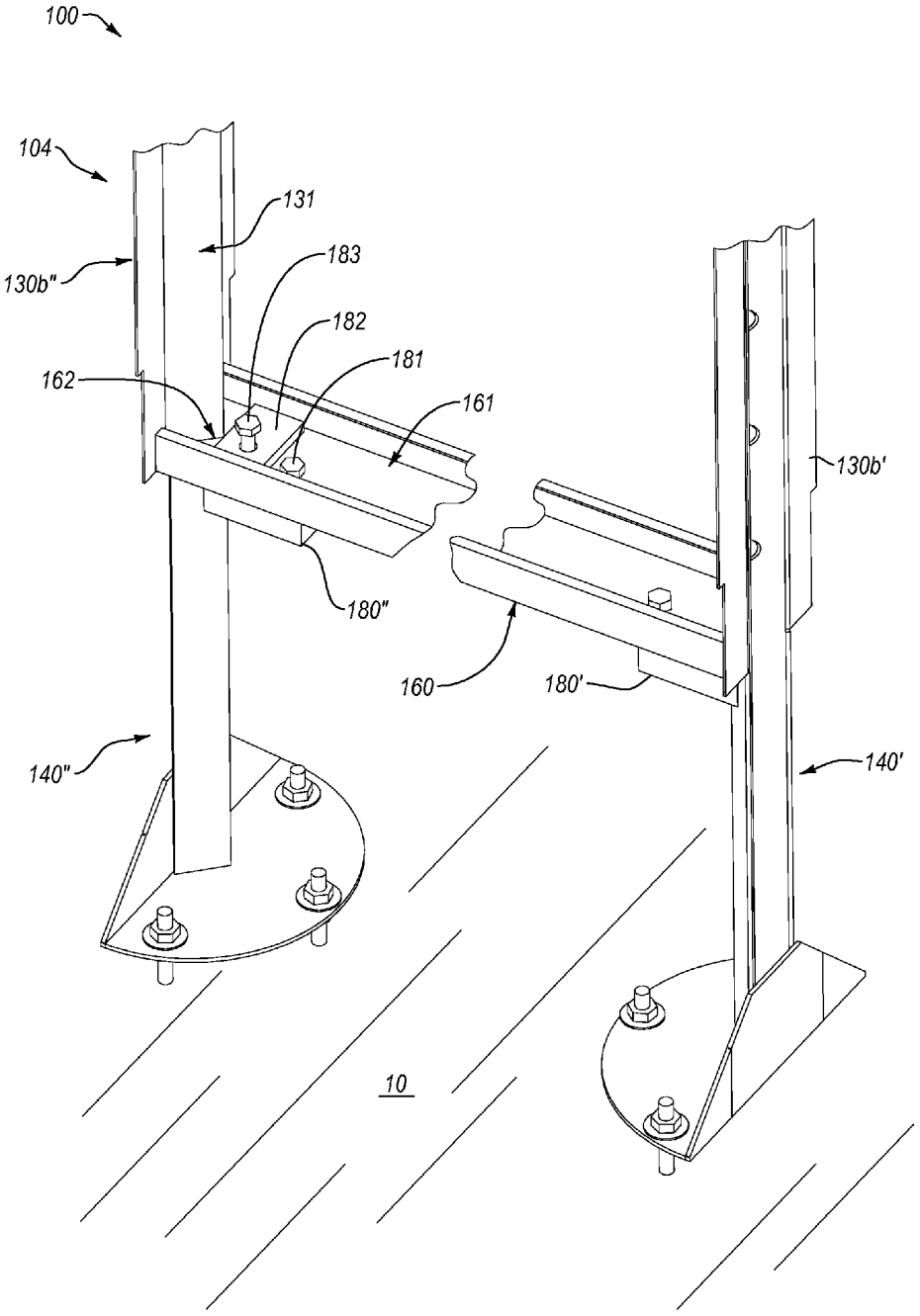
FIG. 1B illustrates an enlarged partial view of the frame of FIG. 1A.
Figure 1D:
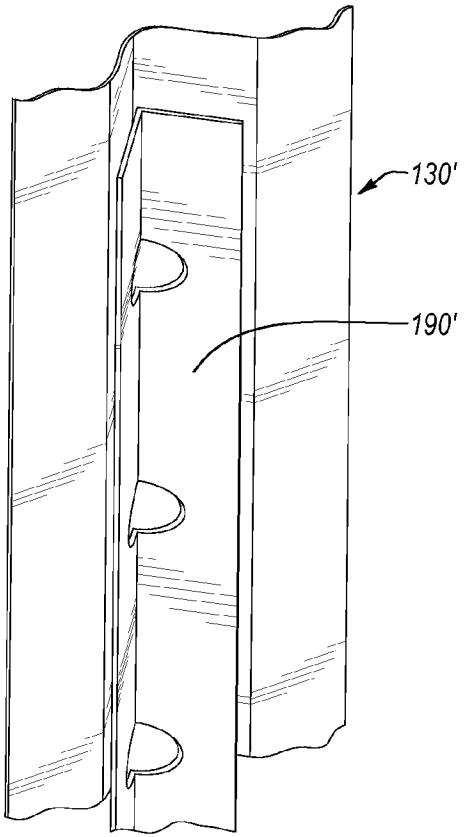
FIG. 1D illustrates one other enlarged partial view of the frame of FIG. 1A.
Figure 1C:
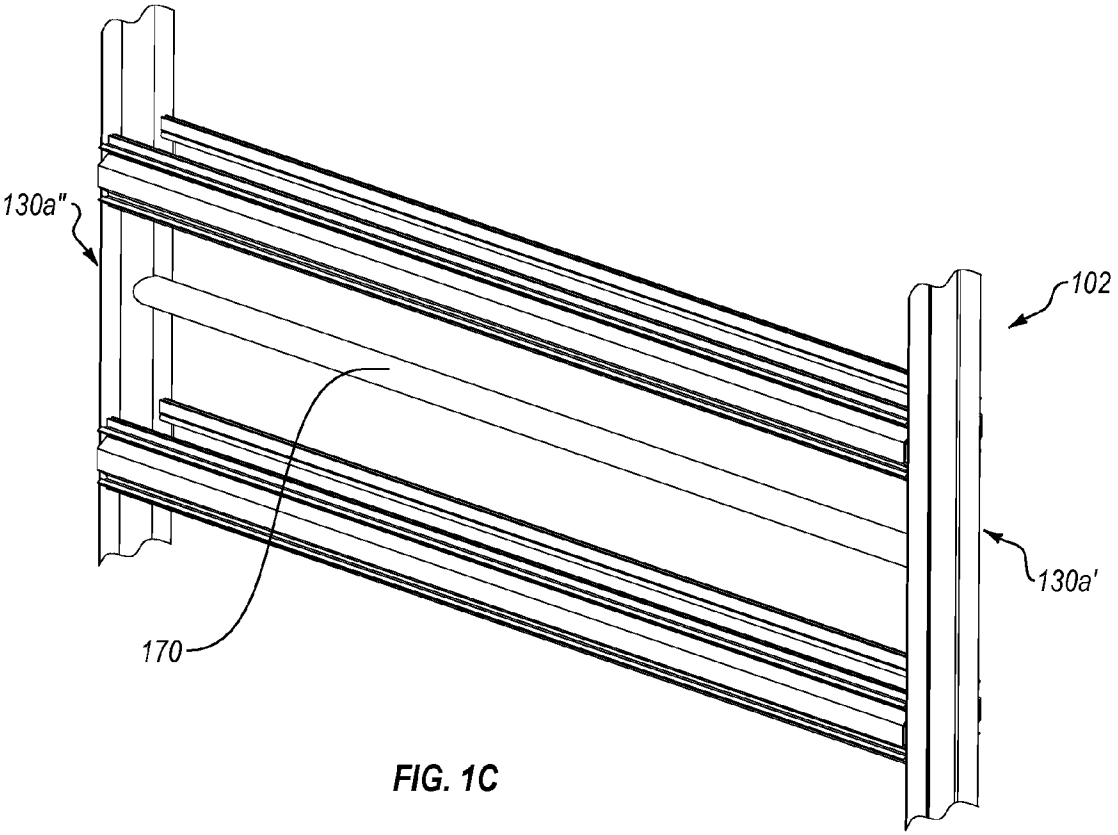
FIG. 1C illustrates another enlarged partial view of the frame of FIG. 1A.

FIGS. 1A-1C illustrate one implementation of a frame 100 for a full-height wall module. The frame 100 also may be converted to a partial-height frame, as further discussed below, and may be used in a partial-height wall module. For example, the builder or installer may mount any number of suitable panels to the frame 100, which may vary from one implementation to another, to complete the wall module. Moreover, such panels may be permanently or removably connected to the frame 100.

In one or more implementations, the frame 100 has a top end 110 that can couple to a ceiling (as described below in connection with FIGS. 4A-4C) and a bottom end 120 that can couple to a support, such as a structural floor 10. As mentioned above, the bottom end 120 can couple to a concrete floor, which may be below a suspended floor of the building. Additionally or alternatively, the bottom end 120 can couple to the suspended floor (i.e., a floor positioned above the structural floor 10).

In one or more implementations, the frame 100 can include multiple left and right vertical supports 130', 130", which can include vertical support 130*a*', 130*a*", 130*b*', 130*b*" connected together. More specifically, the frame 100 can include an upper section 102, which can have vertical supports 130*a*', 130*a*", and lower section 104 that can have vertical supports 130*b*', 130*b*". In addition, the vertical supports 130', 130" can couple to and/or be supported by the floor 10.

For instance, the vertical supports 130', 130" can connect to mounting supports 140', 140", which can rest on and/or be connected to the floor 10. In one implementation, the mounting supports 140', 140" can include a vertical member 141, which can connect the mounting supports to the respective vertical supports 130', 130", and a foot 142, which can add stability to the frame 100. For example, the foot 142 can have an L-shape, a vertical portion of which can connect to or be integrated with the vertical member 141. Accordingly, in at least one implementation, the frame 100 may have a support surface formed or defined by a horizontal portion of the L-shaped foot 142, which can have a larger area than the cross-sectional area of the vertical supports 130', 130" and/or of the vertical member 141 to provide stability for the frame 100.

Additionally or alternatively, the mounting supports 140', 140" may include adjustment members, such as screws 143 connected to the foot 142, which can allow the builder to level and/or orient the mounting supports 140', 140" as well as the frame 100 relative to the floor 10 and/or other structural components or elements of the building. Particularly, the builder can adjust the length of the adjustment member (e.g., screws 143) relative to the mounting supports 140', 140", thereby adjusting orientation of the mounting supports 140', 140" and of the frame 100 relative to the floor 10.

In one implementation, the builder can bolt the vertical supports 130', 130" (or portions thereof) to the floor 10. For instance, the builder can use anchor bolts or screws to fasten and secure the mounting supports 140', 140" to the floor 10. As described above, in some instances, the foot 142 can include an approximately flat portion oriented approximately perpendicularly relative to the vertical member 141. Hence, a portion of the foot 142 can have an approximately parallel orientation relative to the floor 10. Furthermore, the flat portion of the foot 142 (and of the mounting supports 140', 140") can rest directly on the floor 10, while the mounting supports 140', 140" can be bolted to the floor with one or more bolts or screws. Alternatively, in some instances, the adjustment members, such as the screws 143 can space the mounting supports 140', 140" from the floor 10, while the anchor bolts or screws can fasten the mounting supports 140', 140" to the floor 10.

The frame 100 also can include multiple horizontal supports, such as stringers 150, a lower horizontal support 160, torsion bars 170, and combinations thereof. The horizontal supports can provide rigidity to the frame 100 and/or can allow the builder to secure additional components or elements to the frame 100. For example, one or more horizontal supports (e.g., stringers 150) can support and/or secure panels to the frame 100, as described below. Moreover, as mentioned above, the frame 100 can include the top end 110. In one or more implementations, the top end 110 can be connected to or integrated with the vertical supports 130*a*', 130*a*", stringers 150, torsion bars 170, and combinations thereof.

Furthermore, as mentioned above, the frame 100 can have a flexible lower connection, which can allow movement of the frame 100 relative to the floor 10 during seismic events. Allowing such movement (e.g., limited movement) during a seismic event can improve durability and/or seismic resistance of the frame 100. Particularly, the frame 100 can include the lower horizontal support 160 coupled to mounting supports 140', 140". In at least one implementation, a single connection can secure or couple the lower horizontal support 160 to mounting supports 140', 140".

For example, the mounting supports 140', 140" can include platforms 180', 180" that can support the lower horizontal support 160. In addition, as better illustrated in the enlarged view of FIG. 1B, the frame 100 may include fasteners 181 that can connect the lower horizontal support 160 to one or more of the platforms 180', 180". Moreover, in one implementation, the lower horizontal support 160 may include a channel 161 that can accept a resistance block 182 therein, which can restrict or limit twisting and/or rotation of the lower horizontal support 160 relative to the vertical support 130" and vice versa. A fastener 183 can connect the resistance block 182 to the platform 180".

More specifically, in one or more implementations, the vertical supports 130', 130" may, at least in part, have V-shaped profiles (e.g., V-shaped center portions 131). The lower horizontal support 160, in turn, also may have corresponding V-shaped cutouts 162 on the ends thereof, which can at least partially fit over the V-shaped portions 131 of the vertical supports 130', 130". As such, the interface between the V-shaped cutouts 162 and the V-shaped portions 131 can limit rotation and/or twisting of the vertical supports 130', 130" relative to one another as well as relative to the lower horizontal member 160.

Moreover, the resistance block 182 can limit or prevent relative rotation of the lower horizontal support 160 about the vertical support 130". In other words, the resistance block 182 may interface with the channel 161 to limit or prevent rotation of the lower horizontal support 160 about the vertical support 130". At the same time, connection between the lower horizontal support 160 and the opposite vertical support 130' can allow more relative movement (i.e., rotation and/or twisting) between the vertical support 130' and the lower horizontal support 160.

In any case, the lower horizontal support 160 can be rigidly connected at one of the vertical supports 130', 130" and flexibly or movably connected at the other of vertical supports 130', 130". Consequently, the frame 100 and/or the lower section 104 may move during a seismic event in a manner that relative movement of various support structures may not damage or destroy the frame 100. As noted above, the floor 10 may move relative to the ceiling during a seismic event. Hence, as the floor 10 moves relative to the ceiling, the connection between the lower horizontal support 160 and the mounting supports 140', 140" can allow the lower portion of the frame 100 to move and/or flex, thereby avoiding or limiting damage thereto.

In any event, the frame 100 can have a desired degree of flexibility (e.g., components of the frame 100 can flex and/or move relative to each other and/or relative to support structures of the building) at the lower connection thereof. More specifically, the frame 100 can be sufficiently flexible to allow movement or flexing of the various components of the frame 100 during a seismic event. Also, the frame 100 can be sufficiently rigid, to maintain the frame 100 (and the divider wall assembly) stationary in the absence of a seismic event.

For example, as shown in FIG. 1A, the upper section 102 may include a torsion bar 170, which can rigidly connect the vertical supports 130*a*', 130*a*" together. In other words, the torsion bar 170 may prevent or limit relative rotation and/or twisting of the vertical supports 130*a*', 130*a*". In one example, as better illustrated in an enlarged view in FIG. 1C, the torsion bar 170 may include V-shaped cutouts that can fit over corresponding V-shaped portions of the vertical supports 130*a*', 130*a*". It should be appreciated that, for instance, in lieu of the connection between the lower horizontal support 160 and the mounting supports 140', 140" described above, the lower section 104 also can include one or more torsion bars that can limit or prevent relative rotation and/or twisting of the vertical supports 130*b*', 130*b*".

As noted above, in one or more implementations, the wall module can be modifiable from full-height to partial-height and vice versa. Hence, as shown in FIG. 1A, the upper section 102 can selectively couple to the lower section 104. In other words, the upper section 102 can decouple from the lower section 104, thereby converting the frame 100 to a partial-height frame. For instance, the frame 100 can have splines 190', 190" that can couple the upper section 102 to the lower section 104.

In at least one implementation, the upper section 102 and lower section 104 can have channels or grooves that can accept the splines 190', 190" therein. For example, the vertical supports 130*a*', 130*a*" of the upper section and the vertical support 130*b*', 130*b*" of the lower section 104 can include corresponding channels, which can accept the splines 190', 190". In one or more implementations, the outward facing sides of the V-shaped portions of the vertical supports 130*a*', 130*b*', 130*a*", 130*b*" can at least partially form or define V-shaped channels.

FIG. 1D illustrates an enlarged portion of the vertical support 130' and the spline 190' positioned within the V-shaped channel in the vertical supports 130'. Likewise, the vertical supports 130", illustrated in FIG. 1A, can include similar or the same channel, which can accept the spline 190". In any event, the splines 190', 190" can have a V-shape, which can fit into the V-shaped channels of the vertical supports 130*a*', 130*b*', 130*a*", 130*b*". Furthermore, in light of this disclosure it should be appreciated that the splines 190'. 190" and the corresponding channels in the vertical supports 130*a*', 130*b*', 130*a*", 130*b*" can have any number of suitable shapes (i.e., cross-sections) and lengths, which may vary from one implementation to another. Examples of spline and channel shapes include but are not limited to L-shape, U-shape, square, and other shapes as well as combinations thereof.

In any case, the splines 190', 190" can fit into the channels of the respective vertical supports 130*a*', 130*b*', 130*a*", 130*b*", thereby coupling the upper section 102 to the lower section 104. Moreover, the corresponding shapes of the splines 190', 190" and the channels in the vertical supports 130*a*', 130*b*', 130*a*", 130*b*" can prevent relative movement (e.g., lateral and/or axial movement, twisting, rotation, etc.) of the vertical supports 130*a*', 130*b*', 130*a*", 130*b*". Additionally or alternatively, the builder can couple the splines 190', 190" to the upper section 102 and/or to the lower section 104 with fasteners, such as screws.

In at least one implementation, the splines 190', 190" can slide upward and/or downward (i.e., toward the upper and/or lower sections 102, 104) within the channels in the vertical supports 130*a*', 130*b*', 130*a*", 130*b*". Additionally, in some instances, the splines 190' and/or 190" can be contained entirely within the respective vertical supports 130*a*', 130*a*" Likewise, in some instances, the splines 190' and/or 190" can be contained entirely within the respective vertical supports 130*b*', 130*b*" and mounting supports 140', 140". Accordingly, for instance, to reconfigure the divider wall assembly from the full-height configuration to a partial-height configuration, the builder or occupant of the building can disconnect the upper section 102 from the lower section 104 by sliding the splines 190', 190" to be positioned entirely within the lower section 104 or within the upper section 102.

Figure 2B:
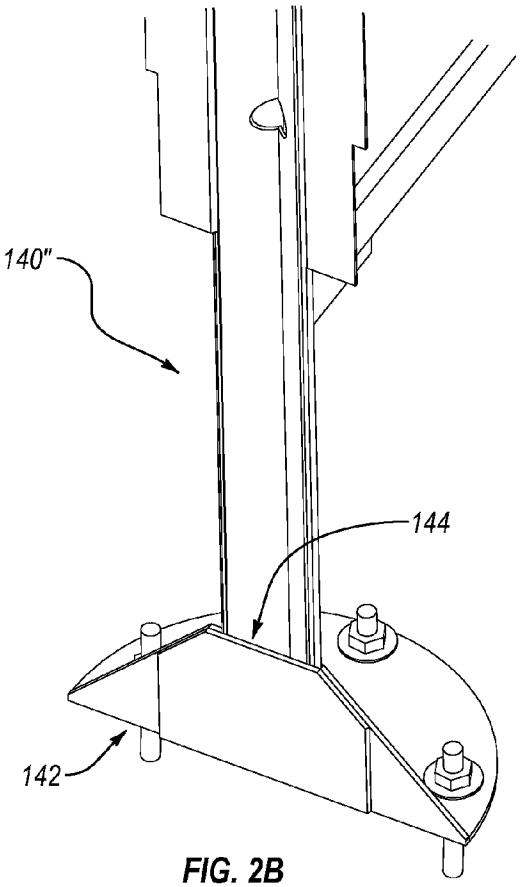
FIG. 2B illustrates an enlarged partial view of the lower section of FIG. 2A.
Figure 2A:
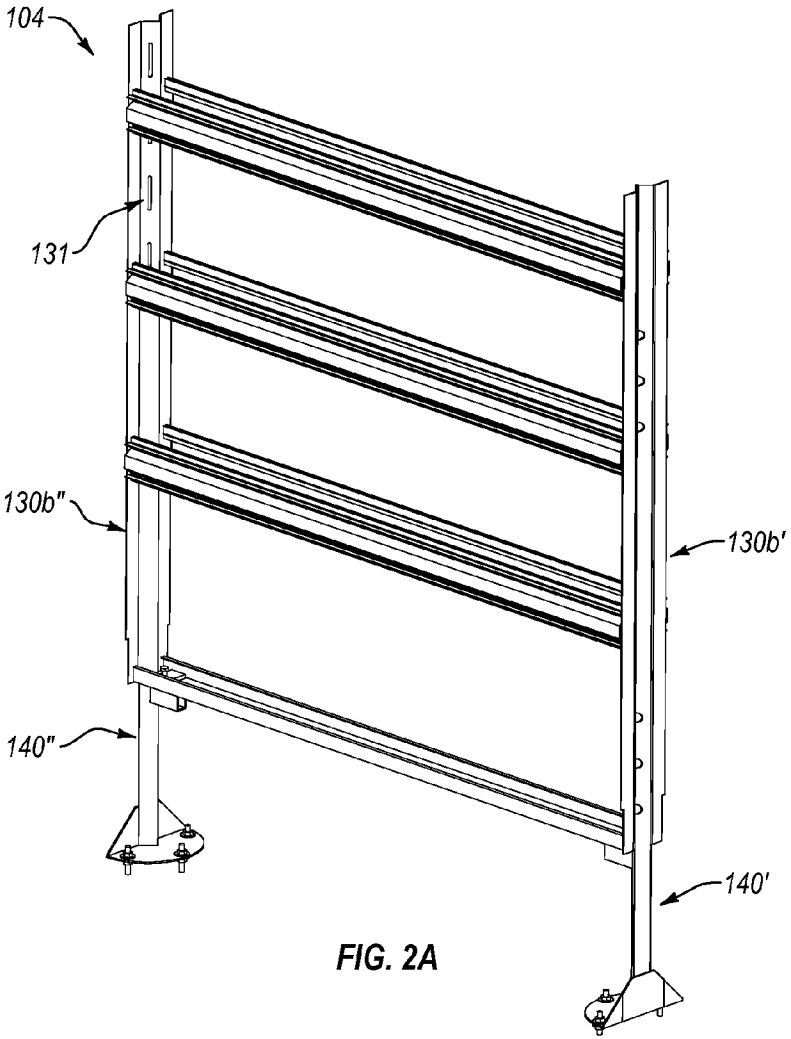
FIG. 2A illustrates a perspective view of a lower section of the frame of FIG. 1A.

FIGS. 2A-2B illustrates one implementation, where the splines 190', 190" are positioned in the lower section 104, thereby forming a partial-height frame that includes only the lower section 104. Specifically, as illustrated in FIG. 2A, the splines 190', 190" can slide within corresponding channels into the respective vertical supports 130*b*', 130*b*" and, in some instances, into the mounting supports 140', 140", thereby disconnecting the upper section from the lower section 104. In other words, as the splines 190', 190" slide out of the channels in the upper section of the frame, the splines 190', 190" release and disconnect the upper section from the lower section 102.

Moreover, as described herein, the splines 190', 190" can enter and remain within the corresponding channels in the vertical supports 130*b*', 130*b*" and/or within the mounting supports 140', 140". Thus, in one implementations, the splines 190', 190" also can reinforce the connection between the mounting supports 140', 140" and the respective vertical supports 130*b*', 130*b*". Moreover, implementations may include mounting supports 140', 140" that can at least partially restrain and/or secure the splines 190', 190" without additional fasteners. Hence, a full-height frame may be reconfigured into a partial-height frame without fastening the splines 190', 190" to the lower section 104. Additionally or alternatively, however, the builder can fasten the splines 190', 190" to the vertical supports 130*b*', 130*b*" and/or to the mounting supports 140', 140".

For example, as illustrated in FIG. 2B, the mounting support 140" may include a pocket 144 formed in the foot 142 of the mounting support 140". Accordingly, the spline 190" can slide into and be secured within the pocket 144 of the mounting support 140". More specifically, the pocket 144 can limit or restrain the spline 190" from lateral movement relative to the mounting support 140". Furthermore, it should be appreciated that the mounting support 140', illustrated in FIG. 2A, also can include a pocket that can secure the spline 190' therein, and which can be similar to or the same as the pocket 144 (FIG. 2B) of the mounting support 140'. Also, in one implementation, the entire channel in the vertical supports 130' and/or 130" (FIG. 1A) or one or more portions thereof can be covered or closed, in a manner to restrain the splines 190', 190" therein. In any event, in at least one implementation, the splines 130*b*', 130*b*" can increase rigidity and stability of the lower section 104.

As mentioned above and further described below, the upper section and/or the lower section 104 of the frame may secure one or more panels, which may form an exterior of the wall module. Consequently, in one implementation, the builder can remove one or more panels from the wall module, thereby gaining access to the elements and components of the frame 100, as illustrated in FIG. 2A. In at least one implementation, the vertical supports 130*b*', 130*b*" as well as the vertical supports of the upper section can have openings, such as slots 131, which can provide access to the splines 190', 190".

In particular, an assembler can engage the splines 190', 190" (e.g., holes in the splines 190', 190") by passing a tool (e.g., a screwdriver) through the slots 131. Once engaged, the user can urge the splines 190' and/or 190" up or down with the tool. Thus, after removing the panels, the builder can slide the splines 190', 190" out of the upper section to disconnect the upper section from the lower section 104. Conversely, to reconnect the upper section to the lower section 104 (i.e., to reconfigure the partial-height frame to a full-height frame), the builder positions the upper section over the lower section 104, slide the splines 190', 190" upward into the upper section, and connects the splines 190', 190" to the upper and lower sections 102, 104 (FIG. 1A).

It should be appreciated that the builder can use the partial-height frame (e.g., the partial height frame that includes only the lower section 104) to configure a partial-height wall module. For example, the builder can reconnect the panels (e.g., if the panels had been previously removed) to lower section 104 to complete the assembly. It should be noted, that the lower section 104 can remain connected to the floor 10 during the reconfiguration of the frame from full-height to partial-height and vice versa.

In light of this disclosure, it should be appreciated that additional support of the lower section 104 provided by the splines 190', 190" can aid the partial-height wall module to remain unaffected during or after a seismic event. The partial-height wall module can remain unaffected because without a fixed connection at the top, rigid connection to the floor can move the partial-height wall module together with the floor, thereby avoiding or limiting damage to the wall module. Furthermore, the builder can provide such reinforcement while reusing existing components (e.g., the splines 190', 190") of the full-height wall module, which can reduce the overall cost of the project.

In light of this disclosure, it should be appreciated that the building or any portion thereof can have any number of partial- and/or full-height wall modules, which can at least partially define various working areas therein. Moreover, particular combinations of wall modules and/or configurations of the working areas can vary from one implementation to another. Likewise, the building can have any number of supports (e.g., vertical, horizontal, mounting, and other supports) that can connect the wall modules to the structural components of the building (e.g., floors, ceiling, walls, etc.).

It should be further noted that lengths of such supports and components or elements thereof also can vary from one implementation to the next. In one or more implementations, the supports can span the entire length of one or more wall modules. Alternatively, the length of the supports can span only a portion of the wall modules.

Figure 3:
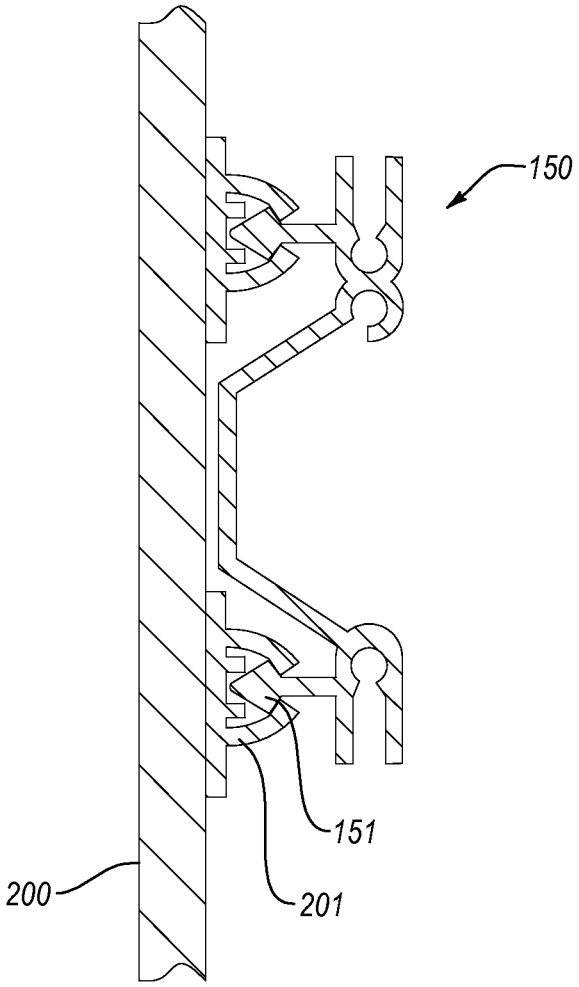
FIG. 3 illustrates a cross-sectional view of connection features for connecting a panel to a frame in accordance with one implementation of the present invention.

As mentioned above, the upper and/or lower sections of the frame (e.g., of the frame 100) can secure one or more panels. More specifically, securing one or more panels to the frame can conceal the frame elements and/or components and can form a partial- or full-height wall module (as described above). Furthermore, the panels can removably connect to the frame, such that the occupant or installer can gain access to the frame components and/or elements by removing one or more panels, which can be reattached thereafter. FIG. 3 illustrates an exemplary connection between a panel and a frame. In one implementation, the upper and lower sections 102, 104 of the frame 100 (FIG. 1A) can include one or more stringers 150, which can provide support and/or increase rigidity of the upper and lower sections. In addition, each of the stringers 150 can secure one or more panels to the frame.

More specifically, the stringer 150 can include one or more connection features 151, which can interface with corresponding connection features 201 of a panel 200. For instance, the connections features 201 of the panel 200 can snap onto the connection features 151 of the stringer 150 and vice versa (i.e., the connections features 201 and 151 are reversible). In one implementation, the connection features 201 can include undercutting portions that can snap about undercuts of the connection features 151, thereby connecting the panel 200 to the stringer 150. It should be appreciated that the connection features 151, 201 of the respective stringer 150 and panel 200 can generally allow an installer to selectively and removably connect the panel 200 to the stinger 150 and can vary from one implementation to another.

Figure 4A:
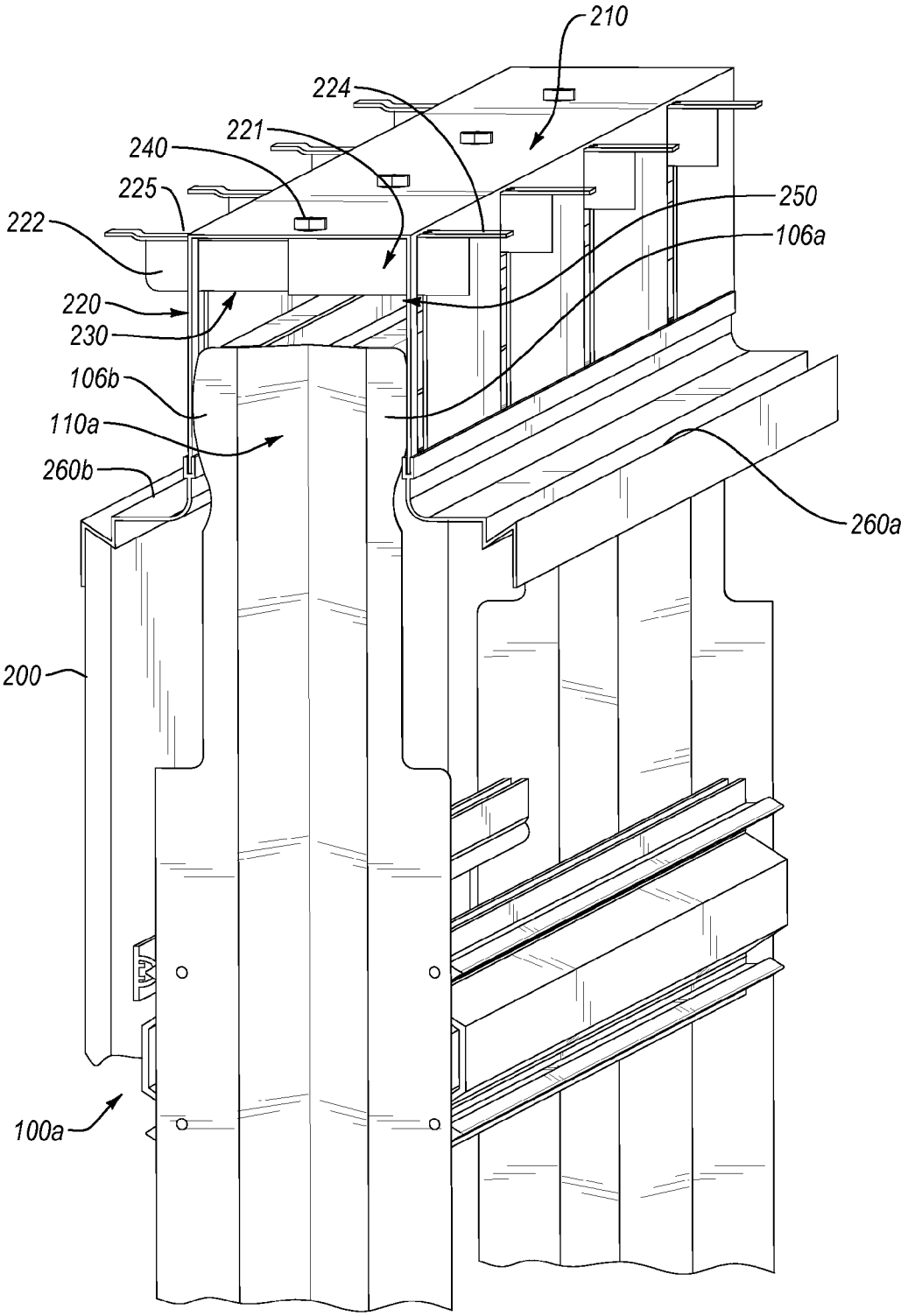
FIG. 4A illustrates a partial perspective view of a frame with a top end secured within a U-shaped channel in accordance with one implementation of the present invention.
Figure 4B:
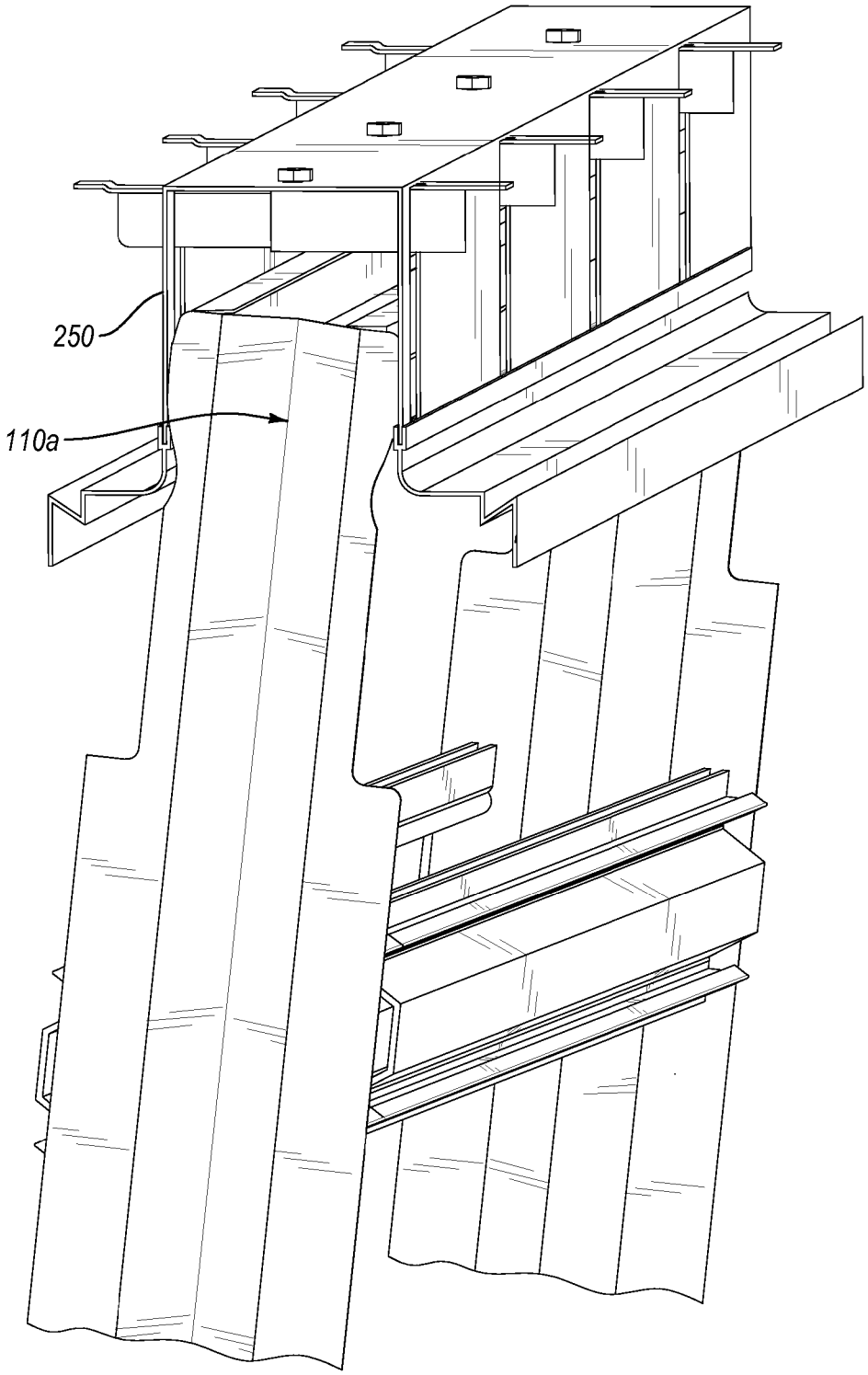
FIG. 4B illustrates the fame of FIG. 4A positioned in a non-vertical orientation in accordance with one implementation of the present invention.
Figure 4C:
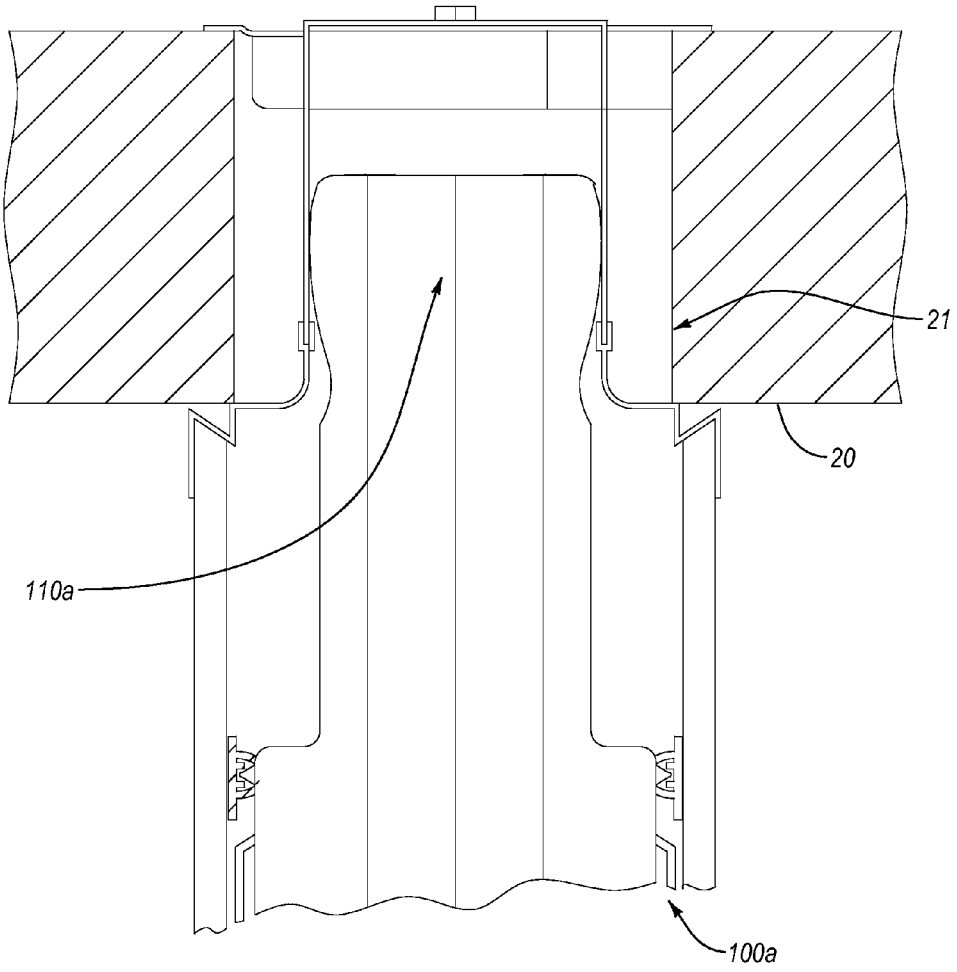
FIG. 4C illustrates an end view of a frame having a top end secured within a U-shaped channel positioned within a slot in a ceiling in accordance with one implementation of the present invention.

As noted above, the frame as well as the wall module that incorporates such frame can connect to a floor and/or to a ceiling. Moreover, implementations can include the frame that can have either a rigid or flexible connection with the floor. Likewise, the frame can either rigidly or flexibly connect to the ceiling. Particularly, in some instances, flexibly connecting the frame to the floor and/or to the ceiling can minimize or avoid damage to the frame during a seismic event (e.g., while the ceiling and the floor move relative to each other). FIGS. 4A-4C illustrate one implementation of a flexible connection of the frame to the ceiling.

More specifically, FIG. 4A illustrates a flexible upper connection assembly 210 connecting or coupling a divider wall assembly or wall module to a structural component of the building (e.g., to a ceiling 20, FIG. 4C). For example, as further described below, the ceiling can have a channel or a slot (e.g., a recessed or protruding slot). In one implementation, the slot can include a bracket secured to the ceiling. In any event, the ceiling can have a slot that can accept the flexible upper connection assembly 210. Moreover, in one or more implementations, the flexible upper connection assembly 210 can couple to a ceiling that does not have slot.

For instance, the flexible upper connection assembly 210 can include a support assembly 220 and a centering bracket 230 secured to the support assembly 220. In one example, a single centering bracket 230 can secure the top end of a frame, as described herein. Hence, the centering bracket 230 may include multiple cutouts that may accommodate or fit over one or more support assemblies 220, which may be secured to the ceiling and/or within a slot in the ceiling. Alternatively or additionally, implementations may include multiple support assemblies 220 that support multiple centering brackets 230 for a single frame or wall module.

In at least one implementation, the support assembly 220 can have a first member 221 and a second member 222. The second member 222 can slidably house the first member 221 in a manner that allows the first member 221 to move laterally relative to the second member 222. Consequently, the builder can adjust the distance between the respective ends of the first member 221 and the second member 222 as may be desired for a particular installation (e.g., to correspond with a particular width of the slot in the ceiling).

Furthermore, the support assembly 220 can have support tabs 224, 225, which can secure the support assembly 220 to the ceiling 20. For example, first member 221 can have the support tab 224 and the second member 222 can have the support tab 225. Hence, the builder can set or otherwise secure the support tabs 224, 225 on a support surface of the ceiling. In other words, for a ceiling that includes a slot, at least a portion of the first member 221 and/or of the second member 222 can protrude into the slot, while the support tabs 244, 225 may be positioned above the slot.

Additionally, the support assembly 220 can include a fastener 240, which can secure the first member 221 to the second member 222. In other words, after sliding the second member 222 and the first member 221 to a desired width (e.g., corresponding with the slot in the ceiling), the builder can fasten the second member 222 and the first member 221 together with the fastener 240. For instance, the fastener 240 can comprise a bolt and a nut. It should be noted, however, that the fastener 240 can vary from one implementation to the other. Furthermore, in light of this disclosure, those skilled in the art should appreciate that the support assembly 220 can have various configurations, which can allow the builder to secure the support assembly 220 to the ceiling and/or within the slot in the ceiling.

In at least one implementation, the second member 222 and/or the first member 221 can have a slot that accepts the fastener 240. Accordingly, the fastener 240 can be partially engaged (e.g., the bolt may have a hand-tight nut thereon), and the fastener 240 can move along the slot, relative to the first member 221 and second member 222. Similarly, the first member 221 and the second member 222 can move relative to each other when the fastener 240 is partially engaged.

The fastener 240 also can secure the centering bracket 230 to the support assembly 220. Likewise, the centering bracket 230 together with the fastener 240 can slide along the slot in the first member 221 and/or the second member 222 and, thus, along the support assembly 220. As noted above, a portion of the wall module can rigidly connect to the building's structural component. For instance, a bottom end of the wall module can connect to the floor of the building.

As described above, in some instances, the building can have a suspended floor, and the wall module can couple to a floor below the suspended floor of the building. Consequently, the suspended floor can have slots or channels therein to accommodate at least a portion of the wall module passing therethrough and connecting to the floor below. In some instances, the slots or channels in the suspended floor may be misaligned with the slot in the ceiling. Therefore, allowing the centering bracket 230 to move along the support assembly 220, and thereby moving within the slot in the ceiling, can allow the builder to properly align and vertically position and orient the wall module and to secure the wall module or a portion thereof (e.g., the frame). In other words, movement of the fastener 240 and/or of the centering bracket 230 relative to the support assembly 220, and the resulting movement of the centering bracket 230 relative to the slot in the ceiling, can accommodate installation of the wall module where the slot in the ceiling is misaligned with the slots or channels in the suspended floor.

As described above, in at least one implementation, the wall module can include one or more panels 200 coupled to a frame 100*a*. Except as otherwise described herein, the frame 100*a* and its materials, elements, or components can be similar to or the same as the frame 100 (FIGS. 1A-1C) and its respective materials, elements, and components. In one example, the centering bracket 230 can include a U-shaped channel 250, which can accept and secure a portion of the wall module. Particularly, the U-shaped channel 250 can secure the top end of the frame 100*a*.

For instance, a top end 110*a* can have substantially the same width as the U-shaped channel 250. Thus, the U-shaped channel 250 can frictionally secure the top end 110*a*, thereby restricting or preventing movement of the top end 110*a* (and of the wall module) relative to the centering bracket 230 and to the ceiling. Particularly, the U-shaped channel 250 and the top end 110*a* can have a press fit (or an interference fit) connection, which can provide sufficient force to restrain the frame 100*a* from moving relative to the ceiling (e.g., absent a seismic event). Moreover, the top end 110*a* can have an at least partially spherical or a rounded shape.

In one implementation, the top end 110*a* can have rounded faces 106*a*, 106*b*. As such, the top end 110*a* can rotate and/or pivot within the U-shaped channel 250. In one example, the U-shape of the U-shaped channel 250 may be formed by the opposing first and second walls of the U-shaped channel 250, which may have a first distance therebetween. Similarly, a width of the top end 110*a* that can fit into the U-shaped channel 250 can be defined by a second distance, which may span between outermost points of the rounded faces 106*a*, 106*b*. As noted above, the top end 110*a* can have an interference fit within the U-shaped channel 250. In other words, the distance between the outermost points of the rounded faces 106*a*, 106*b* can be approximately the same as or greater than the distance between the opposing walls forming the channel in the U-shaped channel 250.

For example, as illustrated in FIG. 4B, the builder can insert the top end 110*a* into the U-shaped channel 250 at a non-vertical angle. Subsequently, the builder can tilt or rotate the top end 110*a* (and consequently the frame 100*a*) within the U-shaped channel 250 to vertically orient the frame 100*a* relative to the building's ceiling and/or floor, as illustrated in FIG. 4A. Moreover, as noted above, in the event that the slot in the ceiling and slots or channels in the suspended floor are misaligned, the builder can move the frame 100*a*, together with the centering bracket 230, within the slot in the ceiling to compensate for such misalignment. After the builder places the frame 100*a* into proper and/or desired alignment, the builder can engage or tighten the fastener 240, to complete the installation of the top end 110*a*.

In at least one implementation, the centering bracket 230 also can include panel covers 260*a*, 260*b*, which can couple to the U-shaped channel 250. The panel covers 260*a*, 260*b* can cover a gap, if any, between the panels 200 and the ceiling. The panel covers 260*a*, 260*b* also can provide additional stability to the wall module and/or can restrain or limit movement of the wall module. In some instances, the frame 100*a* can include cutouts that can facilitate entry of the panel covers 260*a*, 260*b* or portions thereof as the frame 100*a* rotates out of vertical orientation (as shown in FIG. 4B).

As described above, for example, the bottom end of the wall module (or frame 100*a*) can rigidly connect to the floor. Accordingly, the wall module or a portion thereof can move together with the floor during a seismic event (e.g., earthquake). Thus, to avoid damage to the wall module, the top end 110*a* can be movable relative to the ceiling (e.g., relative to the slot in the ceiling). For instance, the frame 100*a* can pivot relative to and/or within the slot in the ceiling.

Additionally or alternatively, the top end 110*a* can move upward and/or downward (e.g., within the slot in the ceiling and/or within the U-shaped channel 250). Also, the frame 100*a* can tilt and/or slide along the length of the U-shaped channel 250. In any event, the top end 110*a* can have sufficient movement within the U-shaped channel 250 to allow the frame 100*a* to move relative to the ceiling in a manner that can avoid damaging or breaking the frame 100*a* as well as the wall module including the frame 100*a*. Furthermore, maintaining flexibility, rather than strengthening, at the sub-floor or similarly at a suspended ceiling can help prevent damage at those points.

As described above, the top end 110*a* of the frame 100*a* can be positioned within a slot or a channel in the ceiling. FIG. 4C illustrates one exemplary installation that includes a slot 21 in the ceiling 20, which can accommodate the top end 110*a* of the frame 100*a*. Specifically, the upper connection assembly can at least partially fit within the slot 21 and can secure the top end 110*a* of the frame 100*a* in a manner described above.

The present invention may be embodied in other specific forms without departing from its spirit or essential characteristics. The described embodiments are to be considered in all respects only as illustrative and not restrictive. The scope of the invention is, therefore, indicated by the appended claims rather than by the foregoing description. All changes that come within the meaning and range of equivalency of the claims are to be embraced within their scope.

We claim:

1. A wall module for defining one or more individual work spaces within a building, the wall module comprising:

an upper section having one or more first vertical supports and one or more first horizontal supports connected to at least one of the one or more first vertical supports, each of the first vertical supports of the one or more first vertical supports including a first channel therein;

a lower section having one or more second vertical supports and one or more second horizontal supports connected to at least one of the one or more second vertical supports, each of the second vertical supports of the one or more second vertical supports including a second channel therein, the first and second channels being aligned with each other;

a plurality of mounting supports connected to the lower section, the plurality of mounting supports including third channels aligned with the second channels; and one or more splines coupling the upper section to the lower section, the one or more splines being slidable within the first, second, and third channels, wherein removing the one or more splines from the first channel and positioning the one or more splines within one or more of the second and third channels decouples the upper section from the lower section;

wherein:

the one or more second vertical supports include a left second vertical support and a right second vertical support; and one horizontal support of the one or more second horizontal supports is rigidly connected to the left second vertical support and flexibly connected to the right second vertical support via a flexible connector, the flexible connector having a joint that allows movement of the wall module relative to one or more structural components of the building.

2. The wall module as recited in claim 1, wherein the one or more first horizontal supports or the one or more second horizontal supports include one or more stringers sized and configured to secure one or more panels.

3. The wall module as recited in claim 2, further comprising one or more panels secured to one or more stringers.

4. The wall module as recited in claim 3, wherein the one or more panels are secured to one or more stringers through snap-fit connections.

5. The wall module as recited in claim 1, further comprising one or more pockets located in the mounting supports, the one or more pockets being sized and configured to secure the one or more splines.

6. The wall module as recited in claim 1, wherein one or more of the first, second, and third channels have a V-shaped configuration.

7. The wall module as recited in claim 6, wherein the one or more first vertical supports include V-shaped portions that at least partially form the first channels.

8. The wall module as recited in claim 7, wherein the one or more first vertical supports include two opposing first vertical supports, the wall module further comprising a torsion bar secured between V-shaped portions of the two opposing first vertical supports.

9. The wall module as recited in claim 8, wherein the torsion bar includes V-shaped cutouts on opposing ends thereof, the V-shaped cutouts being sized and configured to fit over and interface with the V-shaped portions of the two opposing first vertical supports.

10. The wall module as recited in claim 1, wherein the one horizontal support is rigidly connected to the left second vertical support through resistance block.

11. The wall module as recited in claim 10, wherein the one horizontal support is movably connected to the right second vertical support through a v-shaped cutout that is in communication with a v-shaped portion of the right second vertical support.

12. The wall module as recited in claim 1, the one horizontal support is the lowest horizontal support.

13. The wall module as recited in claim 12, the one horizontal support is supported by a platform that extends from the left second vertical support.

14. A wall module for defining one or more individual work spaces within a building, the wall module comprising:

an upper section having one or more first vertical supports and one or more first horizontal supports connected to at least one of the one or more first vertical supports, each of a first vertical supports of the one or more first vertical supports including a first channel therein;

a lower section having one or more second vertical supports and one or more second horizontal supports connected to at least one of the one or more second vertical supports, each of the second vertical supports of the one or more second vertical supports including a second channel therein, the first and second channels being aligned with each other;

a plurality of mounting supports connected to the lower section, the plurality of mounting supports including third channels aligned with the second channels; and wherein:

the one or more second vertical supports include a left second vertical support and a right second vertical support; and one horizontal support of the one or more second horizontal supports is rigidly connected to the left second vertical support and flexibly connected to the right second vertical support via a flexible connector, the flexible connector having a joint that allows movement of the wall module relative to one or more structural components of the building.

15. A wall module for defining one or more individual work spaces within a building, the wall module comprising:

an upper section having one or more first vertical supports and one or more first horizontal supports connected to at least one of the one or more first vertical supports, each of a first vertical supports of the one or more first vertical supports including a first channel therein;

a lower section having one or more second vertical supports and one or more second horizontal supports connected to at least one of the one or more second vertical supports, each of the second vertical supports of the one or more second vertical supports including a second channel therein, the first and second channels being aligned with each other;

a plurality of mounting supports connected to the lower section, the plurality of mounting supports including third channels aligned with the second channels;

one or more splines coupling the upper section to the lower section, the one or more splines being slidable within the first, second, and third channels, wherein removing the one or more splines from the first channel and positioning the one or more splines within one or more of the second and third channels decouples the upper section from the lower section;

wherein:

the one or more second vertical supports include a left second vertical support and a right second vertical support;

one horizontal support of the one or more second horizontal supports is rigidly connected to the left second vertical support and movably connected to the right second vertical support; and one or more of the first, second, and third channels have a V-shaped configuration, the one or more first vertical supports including V-shaped portions that at least partially form the first channels, the one or more first vertical supports including two opposing first vertical supports; and a torsion bar secured between V-shaped portions of the two opposing first vertical supports, the torsion bar including V-shaped cutouts on opposing ends thereof, the V-shaped cutouts being sized and configured to fit over and interface with the V-shaped portions of the two opposing first vertical supports.

* * * * *